US008932450B2

(12) United States Patent
Yeung

(10) Patent No.: US 8,932,450 B2
(45) Date of Patent: Jan. 13, 2015

(54) DECONTAMINATION OF ASPHALTIC HEAVY OIL AND BITUMEN

(75) Inventor: Columba K. Yeung, Calgary (CA)

(73) Assignee: Value Creation Inc., Calgary, Alberta (CA)

( * ) Notice: Subject to any disclaimer, the term of this patent is extended or adjusted under 35 U.S.C. 154(b) by 995 days.

(21) Appl. No.: 12/603,721

(22) Filed: Oct. 22, 2009

(65) Prior Publication Data

US 2010/0116716 A1 May 13, 2010

Related U.S. Application Data

(62) Division of application No. 11/383,671, filed on May 16, 2006, now Pat. No. 7,625,466.

(60) Provisional application No. 60/594,936, filed on May 20, 2005.

(51) Int. Cl.
*C10G 21/14* (2006.01)
*C10G 33/06* (2006.01)
*C10G 21/00* (2006.01)

(52) U.S. Cl.
CPC ..... *C10G 21/003* (2013.01); *C10G 2300/1033* (2013.01); *C10G 2300/206* (2013.01); *C10G 2300/805* (2013.01); *C10G 2300/807* (2013.01)
USPC ..... 208/45; 208/309; 208/311

(58) Field of Classification Search
CPC ..... C10G 21/003; C10G 21/14
USPC ..... 208/45, 309, 251 R, 311
See application file for complete search history.

(56) References Cited

U.S. PATENT DOCUMENTS

| | | | | |
|---|---|---|---|---|
| 3,334,043 | A | 8/1967 | Ferris et al. | |
| 3,684,699 | A * | 8/1972 | Vermeulen et al. | 208/188 |
| 3,830,732 | A | 8/1974 | Gatsis et al. | |
| 4,021,335 | A * | 5/1977 | Beaton | 208/309 |
| 4,125,459 | A | 11/1978 | Garwin | |
| 4,239,616 | A | 12/1980 | Gearhart | |
| 4,273,644 | A | 6/1981 | Harris et al. | |
| 4,278,529 | A | 7/1981 | Gearhart | |
| 4,279,739 | A | 7/1981 | Roach | |
| 4,440,633 | A | 4/1984 | Jacquin et al. | |
| 4,634,520 | A | 1/1987 | Angelov et al. | |
| 4,747,936 | A | 5/1988 | Penning | |
| 4,781,819 | A | 11/1988 | Chirinos et al. | |
| 4,915,819 | A | 4/1990 | Chirinos et al. | |
| 4,944,845 | A | 7/1990 | Bartholic | |
| 5,417,848 | A | 5/1995 | Erdmannsdorfer et al. | |
| 5,814,286 | A | 9/1998 | Hood et al. | |
| 5,948,242 | A | 9/1999 | Ohsol et al. | |
| 5,958,365 | A | 9/1999 | Liu | |
| 6,168,709 | B1 | 1/2001 | Etter | |
| 6,214,213 | B1 | 4/2001 | Tipman et al. | |
| 6,447,685 | B1 | 9/2002 | Saal et al. | |
| 6,849,182 | B2 | 2/2005 | Redding | |
| 7,566,394 | B2 | 7/2009 | Koseoglu | |

FOREIGN PATENT DOCUMENTS

| | | |
|---|---|---|
| CA | 1288377 | 9/1991 |
| GB | 2145730 | 4/1985 |

* cited by examiner

*Primary Examiner* — Prem C Singh
*Assistant Examiner* — Brandi M Doyle
(74) *Attorney, Agent, or Firm* — Bennett Jones LLP

(57) ABSTRACT

A process and apparatus to remove asphaltenic contaminants from bitumen, heavy oil or residue to produce lower viscosity petroleum products and high purity asphaltenes.

12 Claims, 3 Drawing Sheets

DECONTAMINATION OF ASPHALTIC HEAVY OIL AND BITUMEN

CROSS REFERENCE TO RELATED APPLICATIONS

This application is a divisional application of U.S. patent application Ser. No. 11/383,671 filed on May 16, 2006, now U.S. Pat. No. 7,625,466, which claims the priority benefit of U.S. Provisional Patent Application No. 60/594,936 filed on May 20, 2005, entitled "Decontamination of Asphaltic Heavy Oil and Bitumen", the contents of which are incorporated herein by reference.

FIELD OF THE INVENTION

The present invention relates generally to the upgrading of heavy oil and bitumen. In particular, the invention comprises a process and apparatus to remove asphaltenic contaminants from bitumen, heavy oil or residue to produce lower viscosity petroleum products and high purity asphaltenes.

BACKGROUND

The world has huge hydrocarbon reserves in the form of heavy oil. As used herein, the term "heavy oil" generally refers to bitumen, extra heavy oil, heavy oil or residual hydrocarbons, both natural and pyrogenous. Industry defines light crude oil as having an API gravity higher than 31.1° and lower than 870 kg/m$^3$ density, medium oil as having an API gravity between 31.1° and 22.3° and having a density between 870 kg/m$^3$ to 920 kg/m$^3$, heavy oil as having an API gravity between 22.3° and 10° and a density between 920 kg/m$^3$ to 1,000 kg/m$^3$, and extra heavy oil as having an API gravity of less than 10° and a density higher than 1,000 kg/m$^3$. In Canada, bitumen generally refers to extra heavy oil extracted from oil sands. Bitumen does not readily flow without being heated or diluted with low viscosity hydrocarbons.

The development of heavy oil reserves has been restricted by the poor transportability of heavy oil due to its extremely high viscosity components, and its poor processability due to foulants, coke precursors and catalyst poisoning components. These problematic components are collectively referred to herein as "contaminants". The main contaminants are asphaltenic hydrocarbons and very high boiling point polyaromatic hydrocarbons.

In order to produce transportable and readily processable petroleum products suitable for conventional refining, it is necessary to remove the asphaltenic contaminants from the heavy oil. It is known to partially achieve this result by a series of conventional processes. For example, a wellhead emulsion can be processed by de-watering, thermal and chemical de-emulsification, settling, dehydration, cooling, diluent addition (for transportation), atmospheric and vacuum distillations, pentane deasphalting, following by propane deasphalting, and yet the recovered asphaltic material are not pure asphaltenes.

Asphaltic material generally refers to a residual liquid fraction of crude oil, and may include asphaltenes, resins and residual oil. Asphaltenes are complex molecules believed to consist of associated systems of polyaromatic sheets bearing alkyl side chains. They are often the heaviest and most polar fractions found in heavy oil. Heteroatoms O, N and S as well as metals V, Ni and Fe are also present in asphaltenes. The exact molecular structure of asphaltenes is not known because of the complexity of the asphaltene molecules. Therefore, the definitions of asphaltenes are based on their solubility. Generally, asphaltenes are the fraction of oil that is insoluble in paraffinic solvents such as n-heptane or n-pentane, and soluble in aromatic solvents such as benzene or toluene.

It is well known that asphaltenes can be separated from bitumen or asphaltenic crude oil by precipitation with paraffinic solvents such as pentane or heptane. It is conventionally believed that a high solvent to oil ratio is required to separate pure asphaltenes, in the order of 40:1 by volume. At lower solvent levels, commonly used in solvent deasphalting, substantial non-asphaltenic material will precipitate with the asphaltenes. Furthermore, solvent deasphalting relies on multiple theoretical stages of separation of barely immiscible hydrocarbon liquids, and cannot tolerate the presence of water.

The oil yield of solvent deasphalting is limited by the high viscosity of resultant asphaltic materials, particularly for high viscosity bitumen feed. Furthermore, it is difficult to achieve high quality oil with high oil yield, due to the difficulties in achieving clean separation of oil and asphaltic fractions.

In solvent deasphalting, asphalt (essentially asphaltene with residual oil) is produced as a very viscous hot liquid, which forms glassy solids when cooled. This viscous liquid must be heated to a high temperature in order to be transportable, which leads to fouling and plugging limitations.

Another technique for removal of asphaltenes involves breaking a froth of extra heavy oil and water with heat and a diluent solvent such as naphtha. In the case of paraffinic naphtha, partial asphaltene removal results. However, only about 50% of the asphaltenes may be readily removed with this treatment even with multiple stages, therefore, complete asphaltene removal is not practical. As a result, the resulting oils must still be processed by capital intensive technology which is relatively tolerant to asphaltenes.

Therefore, there is a need in the art for a method of selectively and efficiently removing asphaltenic contaminants from heavy oil, which mitigates the difficulties of the prior art.

SUMMARY OF THE INVENTION

The methods of the present invention are based in part on the surprising discovery that substantially complete asphaltene precipitation can be achieved at a relatively low light hydrocarbon agent to oil ratio. Such precipitated asphaltenes have initial particle sizes at micron, even sub-micron levels, which cannot be separated readily using conventional technology. However, in the present invention, without being bound by a theory, it is believed that particle size grows by flocculation, which then permits effective separation.

The light hydrocarbon agent in the present invention comprises non-aromatic light hydrocarbons which serve multiple purposes: an "anti-solvent" to precipitate asphaltenes, a viscosity reducing agent to facilitate asphaltene movement, a demulsifying agent, a density controlling component to facilitate separation of oil and water slurry, a "solvent" to extract residual oil from the asphaltene slurry, and an agent to facilitate control of asphaltene aggregate sizes. The hydrocarbons used in this invention to accomplish one or more of these roles shall be referred to herein as a "decontaminating agent" or "DA".

Therefore, in one aspect, the invention may comprise a method of decontaminating a heavy oil feedstock comprising asphaltenes in an oil/water emulsion, said method comprising the steps of:

(a) conditioning the feedstock with a decontaminating agent, at a ratio of about 10.0 DA:oil ratio (w:w) or less (depending on oil properties and temperature), while substantially maintaining the oil/water emulsion, wherein the decontaminating agent comprises light hydrocarbons having 7 carbon atoms or less and is substantially free of aromatic components;

(b) mixing the oil/water emulsion with decontaminating agent and substantially breaking the oil/water emulsion, allowing the oil phase comprising decontaminated oils and decontaminating agent and the asphaltene/water phase to substantially separate; and (c) recovering the oil phase and recovering the asphaltene/water phase;

(d) treating the asphaltene/water phase from step (c) with additional decontaminating agent to extract residual oils; and allowing a light oil phase to separate from a substantially pure asphaltene/water phase.

The method may further comprise the additional step of recovering asphaltenes from the substantially pure asphaltene/water phase and recycling the light oil phase from step (d) to combine with oil/water emulsion either before or after conditioning.

Preferably, the conditioning step occurs at a temperature between about 70° C. and 200° C. The decontaminating agent preferably comprises a cyclic, olefinic or paraffinic hydrocarbon having between 3 and 7 carbon atoms, or mixtures thereof. The DA:oil ratio after step (b) is preferably less than about 10.0 by weight, more preferably less than about 3.5 by weight and most preferably less than about 2.5 by weight.

The decontaminating agent may be removed from the oil phase recovered from step (c) to produce decontaminated oil. The method may comprise the further step of recycling decontaminating agent from step (d) to combine with the oil/water emulsion either before or after conditioning.

In another aspect of the invention, the invention may comprise a system for decontaminating a heavy oil feedstock comprising asphaltenes in an oil/water emulsion, comprising:

(a) a conditioning module having an feedstock inlet, steam/water inlet, and an emulsion outlet, and further comprising means for adding decontaminating agent to the feedstock either before or after the conditioning module, or before and after the conditioning module;

(b) a first phase separation vessel comprising an upper chamber having an inlet connected to the conditioning module outlet, an oil outlet, and a lower chamber having a decontaminating agent inlet, an optional water/solids outlet, and a slurry outlet, and a downpipe connecting the upper and lower chambers; and (c) a second phase separation vessel comprising an upper chamber having an inlet connected to slurry outlet of the first vessel, an oil outlet, and a lower chamber having a slurry outlet, and a downpipe connecting the upper and lower chambers.

In one embodiment, the system may further comprise decontaminated oil recovery means for separating decontaminating agent and decontaminated oil from the first vessel oil outlet, and decontaminating agent recycle means for reusing decontaminating agent from the oil recovery means in the conditioning module or the first phase separation vessel.

BRIEF DESCRIPTION OF THE DRAWINGS

The invention will now be described with reference to.

DETAILED DESCRIPTION OF THE INVENTION

Figure 1:
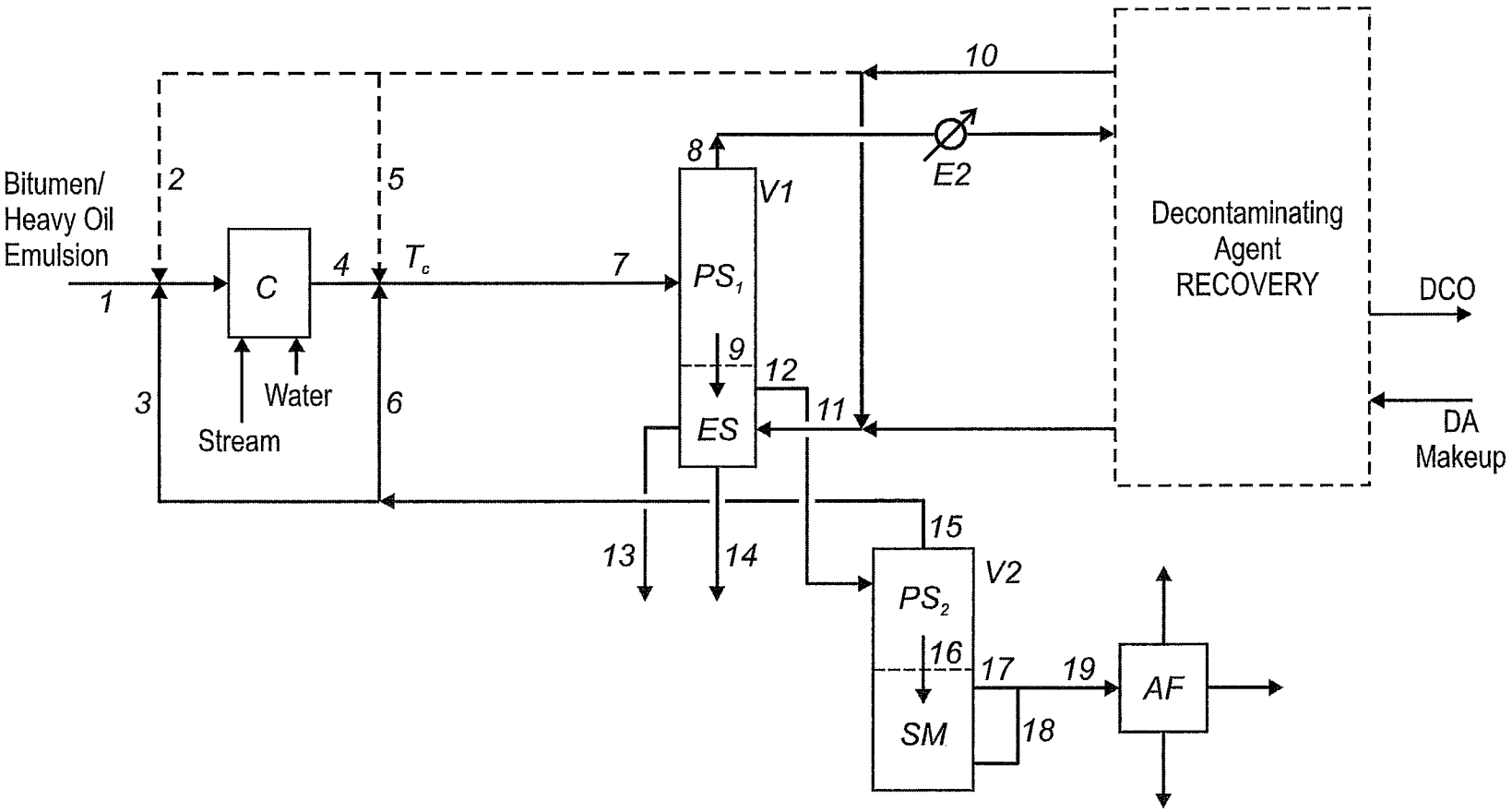
FIG. 1, which is a schematic representation of one embodiment of a decontaminating process.

The present invention provides for novel methods of decontaminating a heavy oil feedstock. When describing the present invention, all terms not defined herein have their common art-recognized meanings. The term "about" used with reference to a numerical value, means a range of 10% above or below the numerical value, or within a range of acceptable measurement error or ambiguity.

One embodiment of the invention is described as follows, with reference to the process flow scheme shown in FIG. 1. For simplicity, pumps are not shown as different pressure profiles can be applied in practice.

The feedstock may comprise heavy oil, which may also be referred to as bitumen, heavy oil or residual oil, and may also include associated solids and bound water. Suitable feedstock may include, for example, field produced emulsions or slurries such as the wellhead production from in-situ steam enhanced production processes, or froth from conventional oil sands bitumen extraction.

The feedstock (1) is first conditioned in a conditioning vessel (C) with the addition of decontaminating agent (2, 3), along with steam or water, or both steam and water, if required. The decontaminating agent is used for the multiple purposes as referred to above. The decontaminating agent may comprise pure light hydrocarbons, preferably $C_3$ to $C_7$, or mixtures of such light hydrocarbons, with substantially no aromatic content. Preferably, the decontaminating agent comprises a non-aromatic, or low-aromatic, light hydrocarbon mixture consisting mainly of $C_4$ to $C_6$ components. The mixture may comprise cyclic, olefinic or paraffinic components. In one embodiment, the decontaminating agent comprises of a $C_5$ mixture.

The condensed steam and water form an oil-water emulsion, which may be either an oil-in-water or water-in-oil emulsion. If an oil-water emulsion, slurry, or froth is used as feedstock, the amount of steam and water used for conditioning can be reduced, or eliminated entirely. An amount of water is required as it is believed the water-oil interface plays an important role in the present invention. Without being bound to a theory, it is believed that during conditioning, relatively pure asphaltenes precipitate as fine particles which migrate to the water-oil interface. The asphaltene particles subsequently flocculate to form aggregates.

In the conditioning step, there are complex relationships among various parameters, which may include temperature, pressure, residence time, decontaminating agent/heavy oil ratio, colloidal suspension power (for asphaltenes) of the oil matrix, molecular weight distribution of asphaltenes, physical properties of decontaminating agent, water droplet size distribution and water/asphaltene ratio and the asphaltene removal target. The optimal or suitable conditions can be determined for any particular feedstock and the desired products, based on empirical testing in properly designed test units.

In general, the pressure is controlled to avoid vaporization of lighter hydrocarbons. Temperature and the decontaminating agent/oil ratio are closely inter-related as both variables affect the viscosity of the liquid medium. Lower viscosity facilitates migration of asphaltenes to the oil-water interface. Temperature can range from pumpable temperature of the diluted bitumen at the low end to the critical temperature of decontaminating agent at the high end. The temperature is preferably maintained in the range of 70° C. to 200° C. The decontaminating agent/oil ratio ("DA/oil ratio") varies widely with feedstock and temperature, but may typically be maintained in the range of 0.2 to 10 w/w, and preferably less than 2.5 w/w for economic reasons.

Residence time during the conditioning step varies from seconds to minutes with high temperature and high DA/oil ratios, to hours or days for low temperature and low DA/oil ratios. In a preferred embodiment, the residence time is maintained below 30 minutes for capital cost efficiency.

The effectiveness of asphaltene removal may depend at least in part on the availability of oil-water interface, which is difficult to measure. For practical purposes, the oil-water interface may be empirically related to emulsion water content. For oil-water emulsion, the water content should preferably be 5% by weight or higher and preferably equal to or greater than the weight percent of asphaltene to be removed. If the feedstock does not contain sufficient water, water or steam, or both water and steam, may be added during the conditioning step.

It is important that the oil-water emulsion remain substantially intact during conditioning, in order to maintain the availability of the oil-water interface. Therefore, conditions which promote deemulsification during conditioning are not preferred.

The decontaminating agent used in the conditioning step can be clean decontaminating agent from a makeup source or decontaminating agent recovered from a later stage, as described herein, or a decontaminating agent-rich stream from a downstream separation vessel. As stated above, emulsion breaking at the conditioning stage should be avoided or minimized.

After conditioning, the diluted emulsion stream with suspended asphaltene aggregates (4) is mixed with hot decontaminating agent (5) or decontaminating agent-rich stream (6), or both streams (5) and (6), under conditions that lead to rapid breaking of the emulsion. Typically, a rise in temperature and the addition of additional decontaminating agent is sufficient to break the emulsion. The accumulated DA/oil ratio is preferably between about 1 to about 10 w/w, and more preferably below 3.5 w/w for cost efficiency. Temperature and DA/oil ratio are interdependent. Temperature can vary from the pumpable temperature of the bitumen-water slurry to the critical temperature of the decontaminating agent, and preferably in the range of about 70° C. to about 200° C., which may depend on the decontaminating agent used.

As shown in FIG. 1, the conditioned and demulsified slurry stream (7) enters the top section (PS1) of a first separation vessel (V1), and separates into an oil phase and an asphaltene-water slurry phase. The separation is quick, more akin to oil-water separation as in a desalting operation, rather than the separation of two oil phases as in solvent extraction or deasphalting.

The bottom stream (9) exiting PS1 is a water slurry of asphaltenes aggregates with some small amount of residual oil. The settling slurry is a relatively thick slurry which can be difficult to pump or centrifuge. Therefore, in a preferred embodiment, the first separation vessel (V1) is divided into two vertically stacked sections, with a downpipe linking the two sections. The thick slurry (9) flows downwards through the downpipe to the lower portion of V1 (ES) which is otherwise sealed from the top section (PS1) and hence the decontaminated oil phase, which remains in PS1.

Upon exiting the downpipe, the asphaltene slurry is immediately mixed with a hot decontaminating agent stream from decontaminating agent recovery (11). The fresh hot decontaminating agent extracts any residual oil remaining with the asphaltenes, and the resultant light oil phase separates readily from the asphaltenes due to the presence of water.

The decontaminating agent-oil and water-asphaltene mixture exits near the top of the ES stage (i.e. bottom section of V1) as stream (12). Clear water settles in the bottom section of ES and can be withdrawn as stream (13). Fine solids, if any, will settle at the bottom of ES and can be purged (14).

Figure 2:
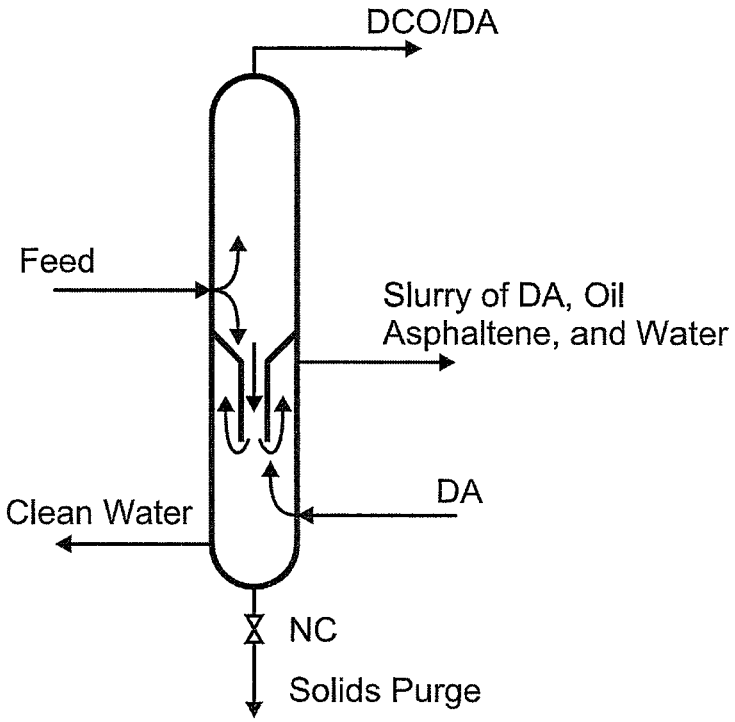
FIG. 2, which is a representation of a separation vessel used in one embodiment of the invention.
Figure 2A:
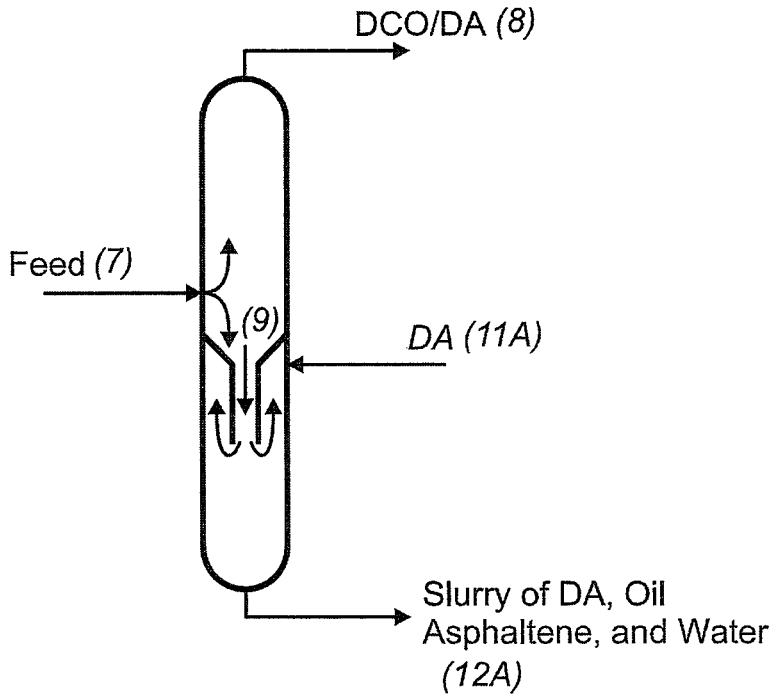
FIG. 2A, which is a representation of an alternative separation vessel.

Alternatively, as shown in FIG. 2A, the decontaminating agent stream may enter (11A) the top section of ES, while the DA-oil and water-asphaltene mixture exits (12A) from the bottom of the ES stage. In this embodiment, a separate water withdrawal (13) or solids purge (14) from ES may not be applied.

PS1 and ES can be separate vessels; however, it is preferred to provide two stages linked by a down-pipe. Gravity is thereby used to displace the asphaltene-water slurry, and the challenge in pumping a thick, sticky slurry can be eliminated.

The decontaminating agent/oil—asphaltene/water slurry stream (12 or 12A) is transported to the top section (PS2) of a second separation vessel (V2). In one embodiment, the second separation vessel is similar or identical to the first separation vessel, but need not be the same in capacity or dimensions. The decontaminating agent stream with extracted oil separates readily from the aqueous asphaltene slurry (16) and is removed as stream (15) as a decontaminating agent-rich stream. It is preferably recycled to the conditioning and emulsion breaking stages (3 and 6). The aqueous asphaltene slurry flows through down-pipes to bottom section (SM) of V2 and is taken off as stream (17) and is transported (19) to downstream facilities for decontaminating agent removal and asphaltene recovery (AF). A split stream (18) of the slurry can be recycled to the bottom of SM to prevent asphaltene settling.

In asphaltene recovery, asphaltenes can be readily removed from the aqueous asphaltene slurry by any conventional and well-known process, for example, by filtration or by flashing.

Light oil, which is substantially free of asphaltenes, and diluted with decontaminating agent, exits V1 as stream (8). The mixture of oil and decontaminating agent is then sent to a decontaminating agent recovery module. The decontaminating agent may be recovered by different light hydrocarbon recovery methods, depending on preferred temperatures and pressures of V1 and V2 specific to applications. Super-critical separation may be an efficient option where higher temperature operation is preferred. Heat input (E2) is usually required for efficient decontaminating agent recovery. The recovered decontaminating agent (10) may then be recycled, to be used at the conditioning stage, emulsion breaking, or within the first separation vessel (2, 5, 11 or 11A).

In a preferred supercritical separation, stream (8) is heated to above the supercritical temperature (Tr) of the decontaminating agent. At this elevated temperature, the decontaminating agent forms a low density fluid which separates readily from the oil. In one embodiment, it is possible to introduce an intermediate separation stage (not shown) at a temperature below (Tr) to effect the separation of stream (8) into a decontaminating agent-rich lighter oil stream and a decontaminating agent-lean heavier oil stream. The decontaminating agent-rich stream may then be subjected to supercritical separation.

Light oil stream (8), once stripped of decontaminating agent in the decontaminating agent recovery module, is produced as decontaminated oil (DCO). DCO may have low to very low asphaltene levels as the process may remove 50% to 99% or better of the asphaltenes present in the feedstock.

EXAMPLE

The following example is presented as an illustration of the present invention, and is not intended to limit the invention as claimed.

A feedstock comprising a bitumen emulsion produced by an in-situ thermal recovery process (35% water by weight) was conditioned at 130° C. for less than 15 minutes with pentane as the decontaminating agent, added to a ratio of less than about 2.5 DA/oil by weight.

As shown in Table 1 below, the recovered DCO had less than 0.56% asphaltenes by weight, compared with 18% in the feedstock with an oil yield of 82% by volume.

TABLE 1

| | FEED | | PRODUCT |
|---|---|---|---|
| | Water | Dry Bitumen | DCO |
| Yield | 35% w | 65% w | 82% v |
| $C_5$ asphaltenes | | 18% w | 0.18 to 0.56% w |

What is claimed:

1. A method of decontaminating a heavy oil feedstock comprising asphaltenes, said method comprising the steps of:

(a) if the feedstock does not comprise an oil-water emulsion with a water content of at least the lesser of 5% by weight or the weight percent of the asphaltenes to be removed, adding steam or water, or both steam and water, to the feedstock to, if required, create an oil-water emulsion having a water content of at least the lesser of 5% by weight or the weight percent of the asphaltenes to be removed;

(b) conditioning the feedstock with a decontaminating agent, at a ratio of less than about 10.0 DA:oil ratio (w:w), while maintaining the oil-water emulsion, wherein the decontaminating agent consisting of light hydrocarbons having 5, 6 or 7 carbon atoms and is free of aromatic components, wherein the conditioning step continues until the asphaltene precipitates as fine particles and flocculate to form aggregates;

(c) subsequently mixing the oil-water emulsion with additional decontaminating agent such that the accumulated DA:oil ratio is between about 1 to about 10 w:w and breaking the oil-water emulsion, allowing an oil phase comprising decontaminated oil and decontaminating agent and an asphaltene/water phase to separate;

(d) recovering the oil phase and recovering the asphaltene/water phase; and (e) treating the asphaltene/water phase from step (d) with additional decontaminating agent to extract residual oils; and allowing a decontaminating agent phase to separate from a pure asphaltene/water phase.

2. The method of claim 1 further comprising the additional step (f) of recovering asphaltenes from the pure asphaltene/water phase from step (e).

3. The method of claim 1 wherein the conditioning step occurs at a temperature between about 70° C. and about 200° C.

4. The method of claim 1 wherein the decontaminating agent comprises a cyclic, olefinic or paraffinic hydrocarbon.

5. The method of claim 4 wherein the DA:oil ratio after step (b) is less than about 10.0 by weight.

6. The method of claim 5 wherein the DA:oil ratio after step (b) is less than about 3.5 by weight.

7. The method of claim 6 wherein the DA:oil ratio after step (b) is less than about 2.5 by weight.

8. The method of claim 7 wherein the accumulated DA:oil ratio after step (c) is less than about 3.5 by weight.

9. The method of claim 1 comprising the additional step (f) of removing decontaminating agent from the oil phase recovered from step (d) to produce decontaminated oil.

10. The method of claim 1 further comprising the additional step (f) of recycling the decontaminating agent phase recovered from step (e) to combine with the oil-water emulsion either before or after conditioning.

11. The method of claim 9 further comprising the additional step (g) of recycling the decontaminating agent removed in step (f) to combine with the oil-water emulsion either during, before or after the conditioning step.

12. The method of claim 1 wherein the decontaminating agent comprises pentane.

* * * * *